United States Patent [19]

Cameron

[11] Patent Number: 4,626,817

[45] Date of Patent: Dec. 2, 1986

[54] CURRENT LIMITING FUSE WITH LESS INVERSE TIME-CURRENT CHARACTERISTIC

[75] Inventor: Frank L. Cameron, N. Huntingdon Township, Huntingdon County, Pa.

[73] Assignee: Westinghouse Electric Corp., Pittsburgh, Pa.

[21] Appl. No.: 724,367

[22] Filed: Apr. 17, 1985

[51] Int. Cl.[4] ..... H01H 85/04

[52] U.S. Cl. ..... 337/162; 337/158; 337/292

[58] Field of Search ..... 337/162, 161, 159, 158, 337/292, 290

[56] References Cited

U.S. PATENT DOCUMENTS

| | | | |
|---|---|---|---|
| 901,261 | 10/1908 | Reynolds et al. | 337/290 |
| 964,592 | 7/1910 | Weston | 337/290 |
| 4,308,515 | 12/1981 | Rooney et al. | 337/162 |

*Primary Examiner*—Harold Broome

*Attorney, Agent, or Firm*—L. P. Johns

[57] ABSTRACT

A current limiting fuse with less-inverse time-current characteristics characterized by a tubular housing having electrical terminals at each end, a fusible structure in the housing and interconnected between the terminals, the fusible structure comprising first fusible portions of silver alloy and second fusible portions of tin alloy intermediate the first fusible portions, and an arc-extinguishing filler around the second fusible portion.

8 Claims, 2 Drawing Figures

CURRENT LIMITING FUSE WITH LESS INVERSE TIME-CURRENT CHARACTERISTIC

BACKGROUND OF THE INVENTION

1. Field of the Invention

This invention relates to electric current interrupting devices and, more particularly, to a full range current limiting fuse suitable for 23 KV and higher application voltages.

2. Description of the Prior Art

The time current melting characteristics of strap-element current-limiting fuses have always been characterized by a relatively steep, inverse shape. It is known that a current-limiting fuse with a less-inverse, time current characteristic would be desirable and more coordinateable. Experience has shown that wire element expulsion type fuses have the less inverse melting characteristic because of the use of wire.

Some prior art fuses utilize a tin-wire fuse element in series with one or more sections of silver current-limiting strap. This combination results in the desired less-inverse characteristic. However, the fuse is complex because the tin wire is enclosed in a flexible thick-walled silicone rubber tube. The tubes in turn are jacketed with a strong covering of woven fiberglass so that pressure generated by the melting and arcing of tin, during interruption, does not explode the silicone rubber tube which would otherwise nullify their ability to assist in the clearing of low currents. Low current clearance is accomplished in the silicone rubber tube design by virtue of generated pressure within the tube blowing the molten tin out of the tube and the current path and into the relatively cool sand where it condenses near the end of the tube. High current clearance is accomplished in the ordinary manner by the series silver strap elements as in any backup type of current limiting fuse.

Associated with the foregoing is the fact that current-limiting fuses are usually mounted vertically which causes the top of the fuse to operate hotter than the lower end so that melting temperatures are affected. This is particularly true where the tin wire is disposed at the hotter end of the tube which causes it to have variable melting characteristics. That is, with the tin wire at one end the melting characteristic band is widened, thereby resulting in an overly wide band resulting in a less coordinateable device.

SUMMARY OF THE INVENTION

In accordance with this invention a current limiting fuse with less inverse time-current characteristic is provided which comprises a tubular casing having electrical terminals at each end thereof, a fusible structure within the casing and having one end connected to one of the terminals and having another end connected to the other of the terminals, the fusible structure including first fusible elements of high current clearing characteristics such as silver or copper, and including a second fusible element of low current characteristics such as tin, the second fusible element being disposed intermediate the first fusible elements and being connected thereto to form a series circuit, and a granular arc-extinguishing filler occupying the casing and surrounding the fusible structure which filler is preferably calcium carbonate surrounding the second fusible element and sand surrounding the first fusible element.

The advantage of the fuse of this invention is that it provides the highly desirable less-inverse time current characteristic which simplifies coordination of the fuse with other protected and protecting devices, that it does not use easily thermally damaged materials to affect the low current clearing, and that calcium carbonate operates safely at 800° C. which allows for the use of low melting metals such as tin.

DESCRIPTION OF THE PREFERRED EMBODIMENT

Figure 1:
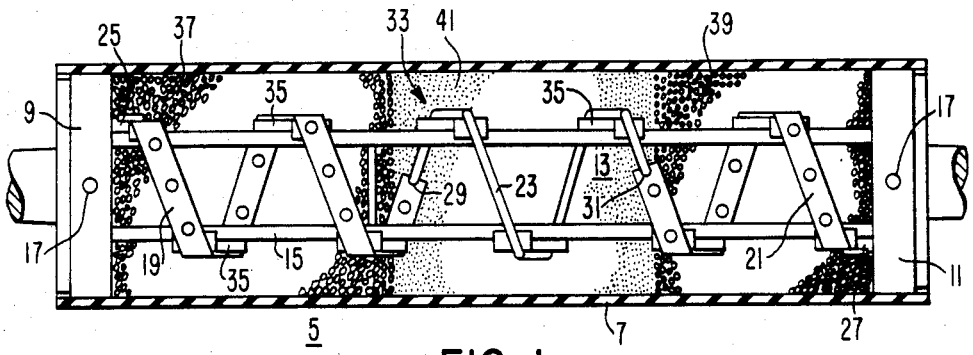
FIG. 1 is a sectional view of a fuse constructed in accordance with this invention.

In FIG. 1 a current limiting fuse is generally indicated at 5 and it comprises a tubular fuse holder or housing 7 having end caps or terminals 9, 11, a fusible structure 13, and a supporting member 15 for the fusible structure. The holder or housing 7 is a cylindrical tubular member which may be composed of an insulating material, such as a glass melamine material. The end caps or terminals 9, 11 are preferably composed of a highly conductive metal, such as copper, and may be silver plated over their entire outer surface. The terminals 9, 11 may be retained in place in a suitable manner, such as by retaining pins 17, which are spaced peripherally around each terminal.

The fusible structure 13 includes first fusible elements 19, 21 of high current clearing characteristic and second fusible element 23 having a low current clearing characteristic. Opposite ends of the first fusible elements 19, 21 are connected to corresponding terminals. Thus, the element 19 is electrically connected at 25 to the terminal 9 and the element 21 is electrically connected at 27 to the terminal 11. The intermediately disposed second fusible element 23 is connected at one end at 29 to the first fusible element 19 and at 31 to the first fusible element 21. The resulting elongated fusible structure 13 is supported on at least two elongated insulating support members 15 extending between and supported by the terminals 9, 11.

A circuit through the fuse 5 extends from the terminal 9 through the element 19, the element 23, and the element 21 to the terminal 17. The interior of the housing 7 is filled with granular refractory material is generally indicated at 33, 37 and 39.

The first fusible elements 19, 21 are dependent upon the desired current clearing characteristics and are in the form of perforated or notched ribbon-like metal having a relatively high melting point. Suitable metals for the elements 19, 21 may be pure or alloys of silver or copper, the former of which melts at about 980° C., and the latter of which melts at about 1082° C. The elements 19, 21 are preferably perforated to perform the current limiting function by reducing the amount of current flowing in the circuit and reducing the amount of energy which occurs at fault.

The second fusible element 23 is comprised of a material having a relatively low melting temperature, such as a metal selected from the group consisting of cadmium, tin, and zinc. Tin, having a melting temperature of about 232° C. in the form of a wire, is preferred.

As shwon in FIG. 1 the fusible structure 13 is disposed in a helically wound manner over the spaced support members 15. At each location of juncture of the elements with the support members 15 it is customary to provide suppressors 35 which are composed of a molded insulative material such as melamine. The suppressors preferably have a melting temperature comparable to that of the material of the corresponding element 19, 21, or 23 (such as alloys of silver or of tin) for evolving a gas that assists in severing the element and cooling the arc so that an arc occurring in the element at the location of the suppressor is quickly extinguished and therefore does not continue to restrike. It is noted, however, that the fusible structure 13 may be disposed on the support members 15 without the suppressors 35 is preferred.

The refractory filler 33 is preferably comprised of adjacent zones of different materials. At filler zones 37, 39 which surround the first fusible elements 19, 21 are preferably composed of sand. A filler zone 41, surrounding the second fusible element 23, is composed of a granular, or powdered, arc extinguishing material selected from the group consisting of calcium carbonate, gypsum, and boric acid, by way of example. Calcium carbonate ($CaCO_3$) has an advantage over materials, such as gypsum and boric acid, in that it begins to decompose only at a temperature significantly higher than that at which either one of the other materials decomposes. Thus a gas is evolved by the $CaCO_3$ at a time when it is most effective for interrupting an arc. The finely powdered $CaCo_3$ traps heat around the element 23 to prevent it from losing heat so that its minimum melting current is reduced. The $CaCO_3$ is a finely powdered material which, upon filling of the fuse packs, form a very cohesive blanket around the wire element 23. Upon melting of the element 23 and commencement of arcing, the $CaCO_3$ deteriorates at a temperature of about 825° C., and decomposes in a narrow tunnel surrounding the element to form a funicular zone of high pressure that expels the melting element from the arc path and into the cooler sand where it is no longer available for enabling restriking of an arc. The $CaCO_3$ does not fuse but, rather, decomposes and therefore forms no conducting fulgurite and thus is very effective in assuring a high voltage withstand capability across the blown fuse. This is especially important in the high voltage fuses, such as at 23 KV.

More particularly, $CaCO_3$ is preferred because it has a very high destructive temperature (about 825° C.). It is preferred that a material be used, such as $CaCO_3$, which is not destroyed until the fuse has melted. Up to the melting point of the element 23 it forms a cohesive blanket which retains the heat within the low current element which is tin and thereby causes its melting to occur at a lower minimum melting current.

Figure 2:
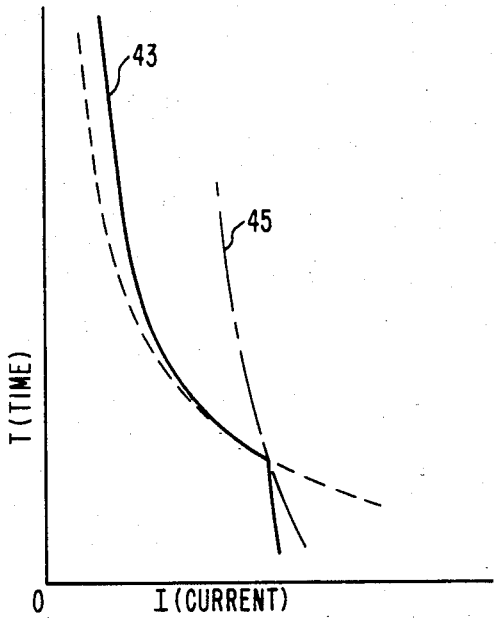
FIG. 2 is a log time current characteristic curve of fusing elements.

The less inverse characteristic of the fuse 5 is indicated in FIG. 2 in which the time current characteristic for silver and tin is shown on a logarithmic scale. The melting curve 43 of the tin wire element intersects and overlays the melting curve 45 of the silver strap elements 19, 21. The further, upper dotted line portion of curve 43 is shown to demonstrate how the actual curve 43 can be controlled by means of varying the width of the $CaCo_3$ bond. The resulting curve is a single plot of the overall final melting characteristic that is achieved by the combination of fusible elements. It is thus apparent that the low overload current time characteristic of the tin is used to interrupt the current in the fuse and thereby prevent the temperature of the fuse from rising to destructive temperatures. Moreover, the high overload or fault current short time characteristic of silver is used to clear the fuse under fault current conditions.

In conclusion the current-limiting fuse with its less inverse time current characteristic satisfies a particular need. The industry has a more limited offering directly as a result of the problems of coordinating fuses with transformers, expulsion fuses and other protective devices.

What is claimed is:

1. A current-limiting fuse with less inverse time-current characteristic, comprising:

a tubular casing;

an electrical terminal at each end of the casing;

a fusible structure within the casing and having one end connected to one of the terminals and the other end connected to the other of the terminals;

the fusible structure including first fusible elements of high current clearing characteristics and including a second fusible element of low current clearing characteristics;

the second fusible element being disposed intermediate the first fusible elements and being connected thereto to form a series circuit;

a granular arc-extinguishing filler occupying the casing and surrounding the fusible structure;

a plurality of spaced support members extending longitudinally of the tubular casing and within the granular arc-extinguishing filler;

the fusible structure being disposed helically over and around the support members;

the arc-extinguishing filler embedding the second fusible element and being selected from the group consisting of calcium carbonate, gypsum, and boric acid;

the first and second fusible elements forming interfaces between the members and the fusible elements; and a body of temperature-responsive, gas-evolving material at each interface to sever the elements when fusion occurs.

2. The fuse of claim 1 in which the second fusible element includes a metallic conductor having a minimum melting current characteristic less than that of the first fusible elements.

3. The fuse of claim 2 in which the first fusible elements are selected from the group consisting of silver and copper.

4. The fuse of claim 3 in which the second fusible element is selected from the group consisting of tin, zinc, and cadmium.

5. The fuse of claim 4 in which the first fusible elements are comprised of silver and the second fusible element is comprised of tin wire.

6. The fuse of claim 1 in which the second fusible element is enclosed in filler of powdered particles of calcium carbonate.

7. The fuse of claim 1 in which the first fusible elements are comprised of the metal selected from the group consisting of silver and copper and the second fusible element is tin.

8. The fuse of claim 1 in which the filler embedding the first fusible structures is comprised of sand.

* * * * *